United States Patent [19]

Jostler

[11] Patent Number: 4,558,556

[45] Date of Patent: Dec. 17, 1985

[54] BELT HAVING A SUCCESSION OF PACKAGING BLANKS AND METHOD FOR FILLING THE BLANKS

[75] Inventor: Jan Jostler, Halmstad, Sweden

[73] Assignee: Joker System Aktiebolag, Halmstad, Sweden

[21] Appl. No.: 354,082

[22] PCT Filed: Jun. 25, 1981

[86] PCT No.: PCT/SE81/00187

§ 371 Date: Jan. 29, 1982

§ 102(e) Date: Jan. 29, 1982

[87] PCT Pub. No.: WO82/00129

PCT Pub. Date: Jan. 21, 1982

[30] Foreign Application Priority Data

| | | | |
|---|---|---|---|
| Jun. 30, 1980 | [SE] | Sweden | 8004829 |
| Jun. 30, 1980 | [SE] | Sweden | 8004830 |
| Oct. 6, 1980 | [SE] | Sweden | 8006976 |

[51] Int. Cl.[4] ..... B65B 43/26

[52] U.S. Cl. ..... 53/459; 53/469; 53/570; 53/568; 141/114; 383/7; 383/22; 383/37

[58] Field of Search ..... 53/459, 468, 469, 372, 53/450, 570, 568; 141/10, 68, 114, 313; 206/390; 229/69; 383/7, 22, 37

[56] References Cited

U.S. PATENT DOCUMENTS

| | | | |
|---|---|---|---|
| 3,599,388 | 8/1971 | Feingold | 53/459 X |
| 3,779,449 | 12/1973 | Membrino | 53/459 X |
| 3,791,573 | 2/1974 | Titchenal et al. | 229/69 |
| 3,817,017 | 6/1974 | Titchenal | 53/459 X |
| 4,291,517 | 9/1981 | Lipes | 53/468 |
| 4,300,608 | 11/1981 | Cuthbertson | 383/22 X |

FOREIGN PATENT DOCUMENTS

| | | | |
|---|---|---|---|
| 894654 | 3/1972 | Canada . | |
| 999561 | 7/1976 | Canada . | |
| 109119 | 9/1967 | Denmark . | |
| 114168 | 6/1969 | Denmark . | |
| 2157072 | 9/1973 | Fed. Rep. of Germany . | |
| 51068 | 6/1976 | Finland . | |
| 2226276 | 11/1974 | France . | |
| 189583 | 1/1964 | Sweden . | |
| 1436118 | 5/1976 | United Kingdom | 53/459 |
| 1509639 | 5/1978 | United Kingdom . | |

*Primary Examiner*—John Sipos
*Assistant Examiner*—Steven P. Weihrouch
*Attorney, Agent, or Firm*—Roberts, Spiecens & Cohen

[57] ABSTRACT

A continuously flexible belt displaying two opposing walls (5, 6) and longitudinal upper and lower edges and incorporating a number of consecutively arranged packaging blanks (2), each with a bottom section (4) at the aforementioned lower edge and two bonding zones (7, 8) arranged transversely in relation to the longitudinal direction of the belt which form the side closures of the packaging blank. In accordance with the invention the belt incorporates two strip sections (10, 11) arranged mainly opposite each other which extend in the longitudinal direction of the belt at its upper edge and which are demarcated from the packaging blanks (2) by a tear initiation (12) arranged in each wall parallel with the upper edge, whereby each strip section (10, 11) is provided with a continuous suspension device (17, 18) for cooperating with packaging blank opening guide devices (19, 20) arranged at a filling station for filling the packaging blanks, both walls of the belt also being provided with slots which have a vertical slot portion (14) arranged between the bonding zones (7, 8) of two adjacent packaging blanks and a horizontal slot portion (16) arranged on either side of the vertical slot portion and between the packaging blanks and the suspension devices, whereby two adjacent horizontal slot portions (16) are arranged at a distance from each other.

5 Claims, 7 Drawing Figures

BELT HAVING A SUCCESSION OF PACKAGING BLANKS AND METHOD FOR FILLING THE BLANKS

FIELD OF THE INVENTION

The present invention relates to a continuous flexible belt which displays two opposing walls and longitudinal upper and lower edges and which incorporates a number of consecutively arranged packaging blanks, each with a bottom section at the aforementioned lower edge and two bonding zones arranged transversely in relation to the longitudinal direction of the belt which form the side closures of the packaging blank. The invention also relates to a method of filling and opening such packaging blanks.

PRIOR ART

British Pat. No. 1 509 639 describes a device for filling bag-shaped packagings of fabric material which are advanced by means of two drive belts in engagement with the outer sides of the packaging belt. The packagings are opened by means of a linkage mechanism and attendant interacting guide devices. The device is complicated and does not satisfy present-day demands for low costs of packaging different kinds of articles. In any event, the device is not suitable for filling bags of plastic material which are arranged in the form of a continuous belt.

SUMMARY OF THE INVENTION

An object of the present invention is to provide a continuous belt of packaging blanks which permits the use of a simplified device for filling the packaging blanks in a simple and reliable manner, particularly packaging blanks of a plastic material.

This is achieved, according to the present invention, in that the continuous belt incorporates two principally opposing strip sections which extend in the longitudinal direction of the belt at its upper edge and which are demarcated from the packaging blanks by means of a tear initiation in each wall arranged parallel to the upper edge, whereby each strip section is provided with a continuous suspension device for cooperating with packaging blank opening guide devices arranged at a filling station for filling the packaging blanks, in addition to which the belt is provided with slots in both walls, each having a vertical slot arranged between the bonding zones of two adjacent packaging blanks and a horizontal slot formed in advance or in conjunction with the filling operation on either side of the vertical slot and between the packaging blanks and the suspension devices, whereby two adjacent horizontal slots are arranged at a distance from each other.

The simplified device according to the invention is characterized in that the guide devices consist of two adjacent guide bars arranged in the same place for co-acting with the specified belt, whereby the guide bars display end sections which are situated in the vicinity of each other and center sections which are situated at a distance from each other, these center sections being arranged to separate the strip sections of the belt in conjunction with the opening of the packaging blanks, whereby the desired material or object is placed in the packaging blanks.

BRIEF DESCRIPTION OF THE VIEWS OF THE DRAWING

The invention is described in greater detail in the following with reference to the drawing, wherein.

DETAILED DESCRIPTION

Figure 1:
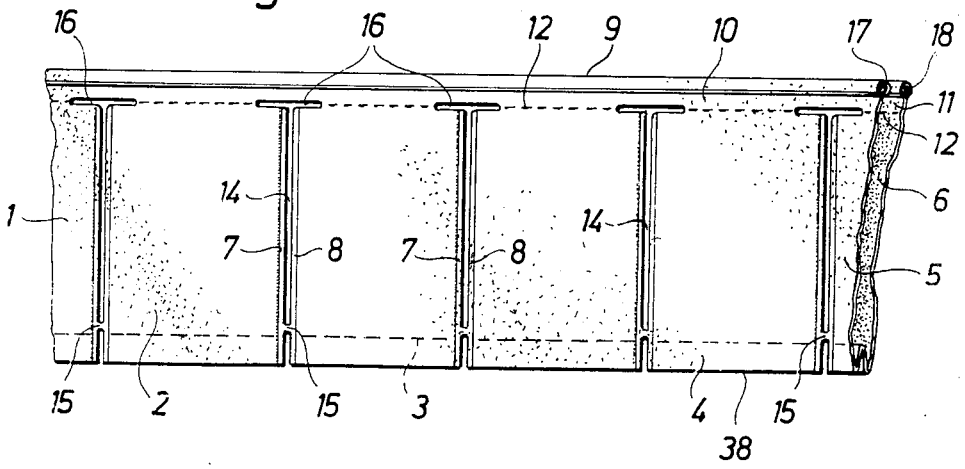
FIG. 1 is a side view of a longitudinal cross-section of a continuous belt according to the present invention.

With reference to FIG. 1, a section of a continuous belt 1, which incorporates a number of consecutively arranged packaging blanks 2, is shown. The belt has been formed by folding a broader material belt along its center line 3 to form a bottom section 4 of the packaging blanks, the bottom section being folded inward as shown in FIG. 1 during formation of the lower edge 38 of the belt. The opposing walls 5, 6 obtained through folding are joined to each other at regular intervals to form bonding zones 7, 8 which extend at right angles to the bottom section 4 of the packaging blanks. The bonding zones, which can be formed by welding gluing, or any any other suitable means, demarcate each packaging blank laterally and extend from the bottom section 4 to an upper point which is situated at a predetermined distance from the upper edge 9 of the belt. The continuous belt also incorporates two longitudinal strip sections 10, 11 which comprise the upper areas of the walls formed through folding and which are demarcated from the packaging blanks by a longitudinal perforation 12 in each wall or other tear initiation which extends principally through the upper points in the bonding zones. The perforation 12 consequently demarcates the packaging blanks at the top and defines the position of their openings 13.

Arranged in or between the bonding zones 7, 8 are vertical slots 14, and each slot 14 may be interrupted by one or more bridges 15 which hold the packaging blanks in a line after each other. Further, horizontal slots 16 are arranged in the area for the boundary between the packaging blanks and the upper strip section 10, 11, i.e. according to the version disclosed in line with the horizontal perforation 12, whereby these horizontal slots 16 are located adjacent to the vertical slots 14 and joined to them in the form of a T. As will be evident from FIG. 1, two adjacent horizontal slots 16 are arranged at a distance from each other. The slots are arranged in both walls 5, 6 as also is the perforation 12.

The two strip sections are both provided with suspension devices which in the version disclosed consist of sections of the walls 5, 6 folded and welded to form longitudinal tunnels 17, 18 of predetermined size.

Figure 2:
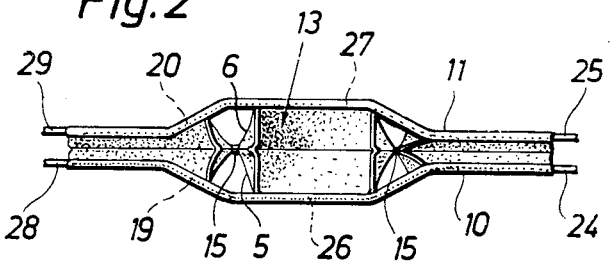
FIG. 2 shows the belt in FIG. 1 from above as it is advanced in a filling station.
Figure 3:
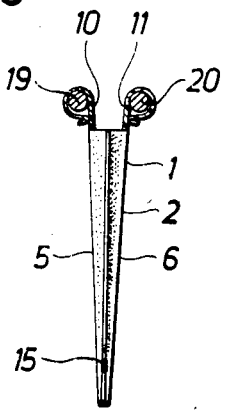
FIG. 3 is a cross-section through the belt along line III—III in FIG. 4.
Figure 4:
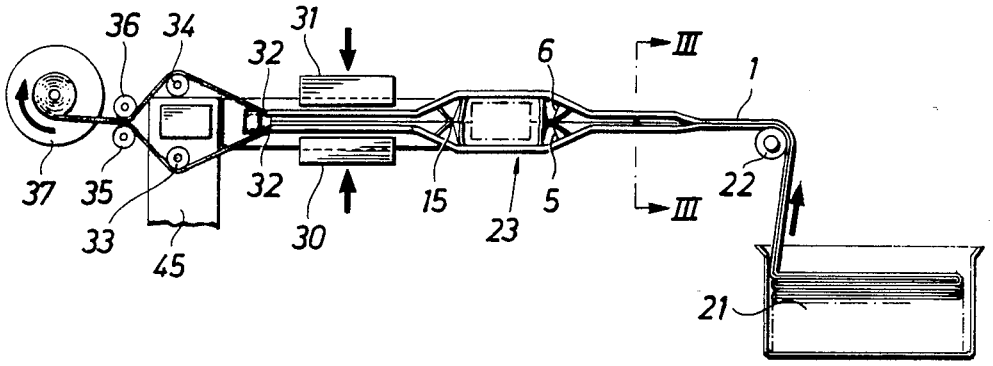
FIG. 4 shows schematically from above a device for handling a belt as in FIG. 1 from magazine to finished packagings.

The aforementioned suspension devices, which are continuous, are arranged to cooperate with special guide devices in the form of two guide bars or guide arms 19, 20 arranged in the same horizontal plane over which the suspension devices easily slide as the belt is advanced. An arrangement incorporating such guide devices is shown schematically in FIGS. 2 and 4. A continuous belt 1 is advanced from a magazine 21 in the version shown in FIG. 4 over a roller 22 to a filling station 23 which incorporates the aforementioned guide devices in the form of the two guide bars 19, 20 arranged in the same horizontal plane which extend through the tunnels of the strip sections. Viewed in the direction of travel, the bars display parallel end sections 24, 25 which are located upstream and situated in close proximity to each other and which open into center sections 26, 27 which are situated at a predetermined distance from each other and which are partially parallel. Alternatively, they may be completely arc-shaped. The end sections 28, 29 located downstream are similarly parallel and situated in close proximity to each other. Situated in the area for the end sections 28, 29 are, in the version disclosed, two interacting welding jaws 30, 31 (FIG. 4) for sealing the packaging blanks after they have been filled at the filling station. The two bars 19, 20 are stationary and are supported by a stand (not shown) at their end sections 28, 29 situated downstream, whereby the transition sections between the bars and the two vertical parts of the stand are arranged with sharp edges to form cutting device 32 for cutting open the tunnels of the strip sections as the belt 1 is advanced. The arrangement also incorporates two opposing guide rollers 33, 34 which bring about such a change in the feed direction of the strips in relation to each other and to the belt that they are torn loose from the belt and from the filled packaging blanks which are collected at a receiving station. From the guide rollers 33, 34 the two strip sections are brought together over guide rollers 35, 36 and collected on a common take-up roller 37 which is arranged to be driven by a drive device (not shown) in the direction indicated by the arrow. The continuous belt is consequently advanced through the drive of the take-up roller 37, whereby the strip sections are accordingly pulled forward over the two guide bars which are arranged to guide the strip sections away from each other at the same time as the packaging blanks are opened so that each blank can be filled with the desired material or object. Opening is made possible, i.e. without damaging the packaging blanks, by the presence of the horizontal slots 16 whose length is chiefly the same as, or slightly more than, the distance between the two bars at their center sections. The bridges 15 can be severed by means of a suitable cutting device at the filling station as has taken place in the version according to FIG. 2 or at another suitable point situated downstream.

A supporting belt or conveyor belt, which primarily extends from the filling station, supports the packaging blanks with their contents. The finished packagings are subsequently received on a conveyor belt 45 which carries the packagings to a receiving station for packing or other handling.

The horizontal slots 16 are formed in advance in the walls at the same time as the vertical slots 14. Alternatively, at least the horizontal slots can be formed in the walls before opening and filling of the packaging blanks, e.g. in close proximity thereto or after the belt has left its magazine 21. Lateral folding of the angular sections between the horizontal and vertical slots will thus be avoided as the belt is advanced, particularly if it is advanced horizontally, unless upper uniting bridges are used.

In the version disclosed, the length of the center sections 26, 27 of the bars is such that a packaging blank 2 can be held fully open between them. If desired, these center sections 26, 27 can nevertheless be extended so that two or more packaging blanks can be opened simultaneously. The belt can be advanced intermittently or continuously, whereby in the latter case the filling device follows the movement of the belt in the filling station. The filling device may incorporate a funnel, e.g. when the material that is to be packaged is in liquid form or in free-running particle form. Alternatively, it may consist of mechanical transfer arms or a conveyor belt. Filling can of course also be carried out manually.

Figure 5:
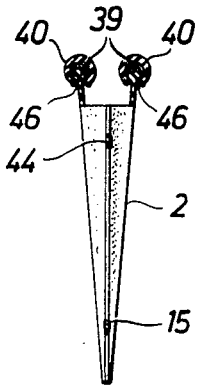
FIG. 5 is a cross-section through a belt and guide devices according to another version of the invention.

The supporting function of the tunnels of the strip sections can also be achieved with other forms of suspension devices. In FIG. 5 these are shown in the form of thicker material 39 with a circular cross-section, whereby the guide devices are modified in a corresponding manner to receive these thicker parts of the material, i.e. guide tubes 40 or guide trails with a downward-facing longitudinal slot 46, whereby the thicker material runs smoothly and without friction inside the tube or rail.

Instead of folding a material belt to form the belt of the packaging blanks it can be formed from two smaller material belts which are placed together and welded, glued or joined in some other manner along an edge to form the bottom sections of the packaging blanks.

The belts of packaging blanks consists of a flexible material which has surfaces which can be welded by heat sealing or which can be glued together or which can be joined in some other manner. A suitable plastic or a laminate which incorporates a suitable plastic layer can be used as the weldable material.

The disclosed guide devices 19, 20 are stationary and completely fixed. The same function of opening the packaging blanks can nevertheless be achieved by means of two straight and movably arranged guide bars which are situated in the same horizontal plane. The guide bars may hereby be capable of parallel lateral movement to outer positions in order to open the packaging blanks or else they may be pivotally journalled at their ends situated downstream so that their free ends can swing out to outer positions in order to open the packaging blanks.

Figure 6:
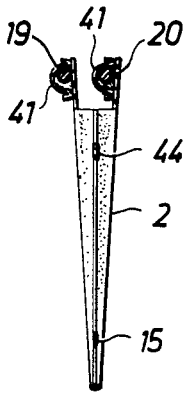
FIG. 6 is a cross-section through a belt and guide devices according to a third version of the invention.

FIG. 6 shows an alternative version of the belt as in FIG. 1, in that the tunnels of the strip sections, instead of folding the walls outward, are formed by separate strips 41 of material which are fixed to the outside of one of the belt walls and to the inside of the other wall.

Figure 7:
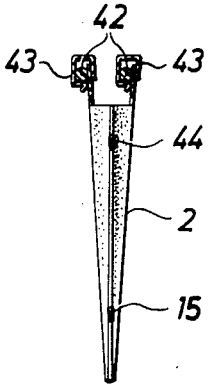
FIG. 7 is a cross-section through a belt and guide devices according to a fourth version of the invention.

FIG. 7 shows an alternative version of the belt and guide devices as in FIG. 5, in that the thicker material of the strip sections instead of being formed by the walls consists of separate round pieces 42 of material which are fixed to the outside and the inside of the belt, whereby the guide devices consist of rails 43 with a downward-facing slot. In the three latter versions (FIGS. 4, 6 and 7) there is also an upper bridge 44 arranged in the vertical slot in the vicinity of the horizontal slot. An upper bridge of this kind is principally easily breakable so that it breaks as a result of the force to which it is subjected when the walls of the belt are forced away from each other in the filling station.

What I claim is:

1. A method of filling packaging blanks arranged in a continuous, flexible belt having two opposing walls and longitudinal first and second edges and including a number of consecutively arranged packaging blanks each with a bottom section at the first edge and two bonding zones arranged transversely in relation to the longitudinal direction of the belt and forming side closures of each packaging blank such that each blank is open at its top at the second edges of the walls, said method comprising moving the belt of packaging blanks from an initial holding station past a filling station to a closing station, holding the belt of packaging blanks at its second edges on guide members the entire second longitudinal edges of the blanks of the belt being constrained by the guide members throughout the path of travel of the blanks from the initial holding thereof through the closing of the filling blanks, slidably advancing the belt longitudinally on the guide members, the belt being advanced past a filling station, guidably displacing the second edges of the blanks apart at the filling station while slidably advancing the second edges of the belt on the guide members to open the top of the blanks at the filling station by the guide members being contoured with diverging portions at the filling station such that the blanks are opened at said filling station solely by the guide members over which the blanks are slidingly fed, filling the thus opened blanks with its contents at said filling station, thereafter advancing the blanks beyond the filling station by slidable advance on the guide members and displacing the slidably supported second edges together on the guide members to close the top of the blanks, and separating the filled blanks from the remainder of the belt along a longitudinal strip at which the blanks are held.

2. A method of filling packaging blanks as claimed in claim 1 comprising supporting the blanks at their second edges by the guide members while the belt is being longitudinally advanced.

3. A method as claimed in claim 2 wherein the support of the blanks at their second edges is effected by suspending the blanks from said guide members at said second edges.

4. A method as in claim 1 wherein said longitudinal strip is formed in each wall of the associated blank by forming tear initiations in said wall.

5. A method as in claim 4 comprising forming horizontal, spaced slots in said wall at each of the bonding zones coincident with the tear initiations.

* * * * *